United States Patent [19]

Malpass

[11] Patent Number: 4,693,371

[45] Date of Patent: Sep. 15, 1987

[54] MEDICATION DISPENSER AND CONTAINER

[75] Inventor: Jack W. Malpass, Andover, N.J.

[73] Assignee: Berlex Laboratories, Inc., Cedar Knolls, N.J.

[21] Appl. No.: 321,665

[22] Filed: Nov. 16, 1981

[51] Int. Cl.[4] ..... B65D 83/04

[52] U.S. Cl. ..... 206/538; 206/534; 206/45.13; 206/539; 206/561

[58] Field of Search ..... 206/1.5, 45.13, 459, 206/534, 535, 538, 539, 557, 558, 561

[56] References Cited

U.S. PATENT DOCUMENTS

| | | | |
|---|---|---|---|
| 2,117,157 | 5/1968 | Florman | 206/1.5 |
| 3,107,204 | 10/1963 | Brown et al. | 206/1.5 |
| 3,225,913 | 12/1965 | Lee | 206/534 |
| 3,241,706 | 3/1960 | Monaco et al. | 206/558 |
| 3,656,681 | 4/1972 | Goings | 206/558 |
| 3,710,900 | 1/1973 | Fink | 206/558 |
| 3,917,106 | 11/1975 | Bargetzi | 206/558 |
| 4,039,080 | 8/1977 | Cappuccilli | 206/561 |
| 4,084,695 | 4/1978 | Halbich | 206/561 |
| 4,191,291 | 3/1980 | Brown | 206/561 |
| 4,192,443 | 3/1980 | McLaren | 229/15 |
| 4,223,787 | 9/1980 | Lowry et al. | 206/1.5 |

FOREIGN PATENT DOCUMENTS 2079250 7/1981 United Kingdom .

*Primary Examiner*—Stephen Marcus
*Assistant Examiner*—David T. Fidei
*Attorney, Agent, or Firm*—Elizabeth A. Bellamy; I. William Millen; Jose Cortina

[57] ABSTRACT

A system and apparatus for containing and dispensing medications in a prescribed manner, and for reducing the possibility of incorrect dosages being taken and/or medication being taken at the wrong time of the day. A tray contains plural rows and columns of cavities, and each cavity is adapted to contain medication therein. The cavities include structure dividing them into two parts. A first part is open to the user to enable the user to place medication therein and to remove medication therefrom. A second part is closed off from direct access by the user in semi-permanent fashion by a transparent enclosure and is used to contain in a preferred embodiment, an exemplification of a appropriate dosage of medication to be taken. For example, if five green pills are to be taken, the enclosed portion will contain five green pills viewable through the transparent enclosure. The dose example of medication contained therein is the dose amount and type medication to be placed in each open cavity structure each day. The columns are preferably labelled at the top thereof with the time of the day at which the medication in the corresponding column is to be taken. Likewise, the rows are labelled to identify the medication corresponding thereto. There is also provided space adjacent each row for instructions to be set out for the user's benefit. In another embodiment, the closed off portion of each cavity merely contains a single sample for comparison purposes, i.e., by viewing through the transparent enclosure, for ensuring that the correct medication is placed in the open portion each day.

23 Claims, 10 Drawing Figures

MEDICATION DISPENSER AND CONTAINER

BACKGROUND OF THE INVENTION

This invention is directed to a system and apparatus for containing and dispensing medical preparations in a prearranged order.

Prior art devices and systems of this type are known, e.g., U.S. Pat. No. 4,039,080 which provides a dosage-indicating pill tray having individual compartments for holding pills. Such trays are arranged in rectangular formats having a plurality of columns and rows with indicia adjacent each column indicating the day of the week, and indicia adjacent the rows indicating the time of day that the medication in each compartment is to be taken. The appropriate dosage is placed inside each compartment corresponding to the appropriate day of the week and time of the day at which said dosage is to be taken.

Another type prior art device shown in U.S. Pat. No. 3,537,422 discloses a dispenser intended for persons who for long periods of time must take several types of medicaments. For example, such a person may require one type of tablet once a day, another type of tablet at meals, and perhaps a third type of tablet at night. The above-discussed type device provides a dispenser body divided into a plurality of compartments arranged in seven rows, one for each weekday, and four consecutive compartments in each row, for instance for breakfast, lunch, dinner, and supper. Each compartment includes corresponding indicia showing the type and prescribed dosage of the medication or other preparation.

These prior art devices have in common the disadvantage that there is no provision for ensuring that the correct pill and dosage be placed in the correct compartment on a day to day basis. Thus, with the prior art devices a patient could easily place either the wrong medication or dosage in an incorrect compartment possibly creating serious medical complications. As the population grows older, the possibility of geriatric confusion and mistake becomes greater. Thus, there is a need for a more fool-proof system.

OBJECTS OF THE INVENTION

It is therefore an object of the invention to provide a medication dispenser adapted for ensuring that a patient, i.e., the user take the correct medication and the correct dosage of medication at prescribed times on a day to day basis.

Upon further study of the specification and appended claims, further objects and advantages of this invention will become apparent to those skilled in the art.

SUMMARY OF THE INVENTION

In accordance with the invention, there is arranged in a unitary dispenser, means for holding and displaying samples of, and/or a large amount of medication to be taken. The means for holding and displaying the samples is adapted to generally cover a single sample, and/or an exemplification of the individual dose of medication, and for viewing purposes will be transparent. Thus, by viewing and displaying the samples, and/or exemplification of the dose of medication in the means for holding and displaying, respectively corresponding portions of the dispenser can be filled with the correct medication corresponding thereto, i.e., contained in the means for holding and displaying with the possibility of confusion and the wrong medication being placed in an inappropriate dispensing portion thereof substantially reduced.

In a preferred embodiment there is provided a tray having a plurality of cavities arranged in rows and columns. At the top of each column there is provided space for an indication of the time of the day at which medication contained in the cavities in each column is to be administered. In addition, an outer cover is provided with the inside thereof having indicia adjacent each row identifying the medication contained in the cavities of each row as well as providing instructions for taking said medication.

In the preferred embodiment there is also provided an inner cover shaped with a plurality of depressions. Each depression is located to correspond to respective ones of said cavities so that when the inner cover is arranged so as to close off the cavities in the tray, the depressed portions thereof will extend partly into each cavity. Each depressed portion defines a medication holding compartment for holding the day's medication therein. The inner cover is of a transparent construction so that the contents, i.e., the exemplified dose of medication in each cavity can be viewed by merely looking through the bottom of each depressed portion of the inner cover.

In preparing the device for the user, a pharmacist, physician, or other person will open the inner cover and fill each cavity, i.e., for each type medication and time of day, with an example of the dosage of medication corresponding to the time of day at which medication will be taken. For example, if the patient is to take five green pills at noon every day, the cavity corresponding thereto will be filled with five green pills viewable through the transparent inner cover. After this filling operation is performed, the inner cover is closed and is not to be opened by the patient. More specifically, once closed the inner cover will be very difficult to open so that access thereto should only be allowed by a pharmacist, doctor, person in charge of the patient or other qualified party. Thus, at the start of each day, the patient or a person in charge or the patient will pull the appropriate dose of medication for the day out of conventional medicine bottles or containers, and place it in each of the corresponding depressed portions in accordance with the instructions on the inside of the outer cover adjacent each row and as shown by the example, e.g., the five green pills, in the cavity below. As a result of this operation there is a substantially reduced probability of the wrong medication being placed in a compartment because an example of the dosage of medication corresponding to each depressed portion compartment can be seen in each cavity through the bottom of each depressed portion, as a result of the inner cover being made transparent, and directly compared to the actual medication placed in each depressed portion.

Another feature of the preferred embodiment is that a cassette holding region is provided on the tray, and a cassette having a single row of cavities with indicia provided, preferably on the inside of the cover thereof, for different times of the day. Thus, after the medication is placed in each depressed portion of each column of the main tray, they will be pooled into each of the respective cavities of the cassette according to the respective time column. The cassette will then be closed and removed from the main tray and carried by the user. This cassette provides ease in carrying around the daily dose medication while at the same time, in combination with the main tray, serves to eliminate or reduce the possibility of the wrong dosage or medication being taken.

In another embodiment of the invention there is provided a unitary medication dispenser having a plurality of dual-structure cavities arranged in rows and columns. The columns have indicia at the top thereof indicating the time of day at which the appropriate medication is to be taken. Each row also includes indicia on the side identifying the medication to be taken as well as instructions for taking the medication.

Each cavity has a generally U-shaped portion, i.e., open to the user of the device, in which the medication for each day is to be contained. Immediately below to the open portion there is a portion closed by a clear transparent wall, i.e., a closed section, in which there is contained either a single sample, or a sample total dose of medication to be placed in the open portion associated therewith. Thus, the user can look into the open portion and through the clear or transparent cover of the closed portion and into the associated closed portion to see the sample pill or medication contained therein. Thus, the user will know with what type of pill and/or how many pills with which to fill the open cavity or portion.

In this regard, it is well known that different types of drugs will have different shapes, colors, sizes, and surface markings. Examples of how such drugs and medication vary can be seen in the Product identification section, i.e., section 5 of the 1981 35th edition of the Physician's Desk Reference, i.e., PDR®. Thus, according to the invention, a single sample or sample dose of a specific type pill or medication to be placed in each compartment portion that is open to the user will be located within the closed portion associated therewith.

In still another embodiment, the respectively associated open and closed portions will be located adjacent each other thereby facilitating a side-by-side comparison of the medication placed in the open portion with the sample and/or medication located in the closed portion. It should also be noted that in this embodiment the user can place in the sample containing section the number of, e.g., tablets corresponding to the prescribed dosage to avoid the problem of taking either a reduced dosage or overdose of the prescribed medication.

Generally, it is preferred that a friend, or other party of sound mind, of the user place the medication or samples in the means for holding and displaying. The intent behind a second person filling in the means for holding and displaying being that the patient will have had the medication dispenser prepared for his own personal use. Other parties which can be used to fill in the means for holding and displaying can include a pharmacist or the patient's doctor. As a result, it is clear that the means for holding and displaying will be designed to be maintained closed in a semi-permanent manner with only limited access permitted.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DISCUSSION OF THE INVENTION

Figure 1:
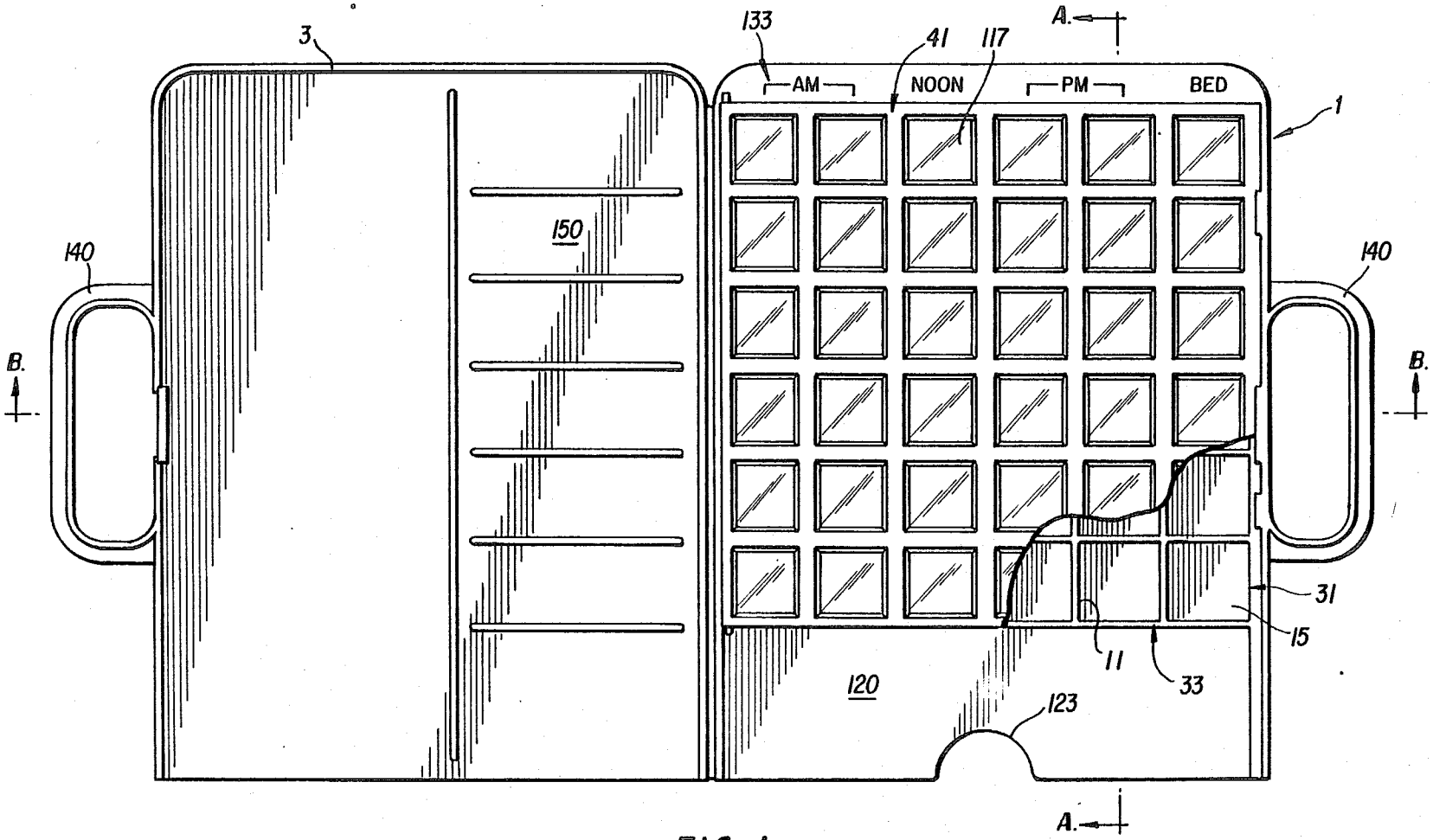
FIG. 1 is a top plan view of the preferred embodiment of the medication container/dispenser of the invention shown in open form with the inner lid closed and the cassette removed.

FIG. 1 is a top plan view of the preferred embodiment of the medication dispenser/container of the invention. In FIG. 1, a main body or tray includes a plurality of compartments 15 are arranged in rows 31 and columns 33 therein. Each compartment 15 is separated from the others by dividers 11. In the preferred embodiment, each compartment will be sufficiently large to contain an example of a total dose of a medication to be taken at a particular time each day. For example, if five green pills are to be taken at noon each day, a corresponding compartment will contain five green pills for illustrative purposes.

An inner cover 41 is hinged to the main tray 1 at one side thereof and includes a plurality of depressions. The depressions make up cavities 117 which are sufficiently large to contain, e.g., at least three no. 9 pills, or as stated above, if the dose to be taken is five green pills, then the cavities 117 will be large enough to contain 5 green pills. The cavities 117 are arranged so that when the inner cover 41 is closed, each cavity 117 will project downwardly into a corresponding compartment 15. Thus, there will be direct correspondence between the cavities 117 and the compartments. Furthermore, the inner cover 41 will be made of transparent material so that the user can look through the bottom of each cavity 117 into the corresponding compartment 15. In the preferred construction there will be 36 cavities and the inner cover 41 will latch closed in a secure manner so as to not come loose easily as a result of jolts or other types of shocks. Furthermore, it is intended, as previously discussed, that the inner cover 41 can be opened only by a predetermined party in charge. The construction of the latching arrangement is conventional, one example of which is shown in the drawings.

At the top of each column 33 there is provided indicia means 133 for providing an indication of the time of the day each medication in the respective columns is to be taken. In this regard, it is preferred that there be 6 columns, i.e., two for morning hours, one at noon, two for the evening or afternoon, and one for bedtime. Correspondingly, if the preferred format with 36 total compartments is followed, there will be 6 rows for 6 different types of medication.

The main tray 1 will also include an outer cover 3 for closing off access to the contents of the tray 1. The cover 3 includes a column of indicia 150 on the inside surface thereof adjacent each row 31 of the main tray. Accordingly, appropriate instructions for the administration of the medication and/or filling of the cavities 15 can be added. The outer cover 3, like the inner cover 41 will be hingedly attached to the main tray.

Another feature of the main tray 1 is the provision at the bottom portion thereof of a region 120 especially adapted for removably holding a cassette 125 therein. Furthermore, the region 120 will include in the back wall thereof a cutout portion 123 which will allow the user to exert direct pressure on the cassette 125 when it is desired to separate it from the main tray 1.

The cassette 125 will have a main body 129 and a lid 131 hingedly attached thereto. The main body 129 will have a row of 6 cavities 133, each corresponding to the respective different time indicia of the main tray 1. Accordingly, the inside of the lid 131 will preferably contain indicia (not shown) similar to those of the columns of the main tray 1. Alternatively, the indicia can be on the outside of the lid. Furthermore, this lid 131 will be adapted for latching closed and securedly closing-off the cavities 133.

In operation, a pharmacist, doctor or other person will typically fill the compartments 15 of the main tray 1 with an example of the amounts of medication to be taken at a particular time of the day, e.g., five green pills at noon. The cover 41 will then be closed in a semipermanent fashion so as to not be opened at any time by the patient. Then each day the patient pulls medication out of conventional medication containers and fill each one of the cavities 117 with medication in an amount as shown in the corresponding compartment 15 through the transparent lid 41 and in accordance with the instructions on the inside of the outer cover 3. Accordingly, since the bottom of each cavity 117 is transparent, the medication placed therein can then be directly compared with the medication in the corresponding compartment 15 and the possibility of the wrong medication and/or dose being taken at the wrong time is substantially reduced.

At this time two options are available. One option is that the patient can simply close the outer cover 3 and carry the dispenser/container around by a two part handle 140. Alternatively, the cassette 125 can be removed, opened and the pills or medication for each time of the day pooled into the corresponding cavity. Thus, the patient need not carry the entire medication dispenser/container around, and the entire day's dose of medication can be carried in a convenient manner.

Figure 7:
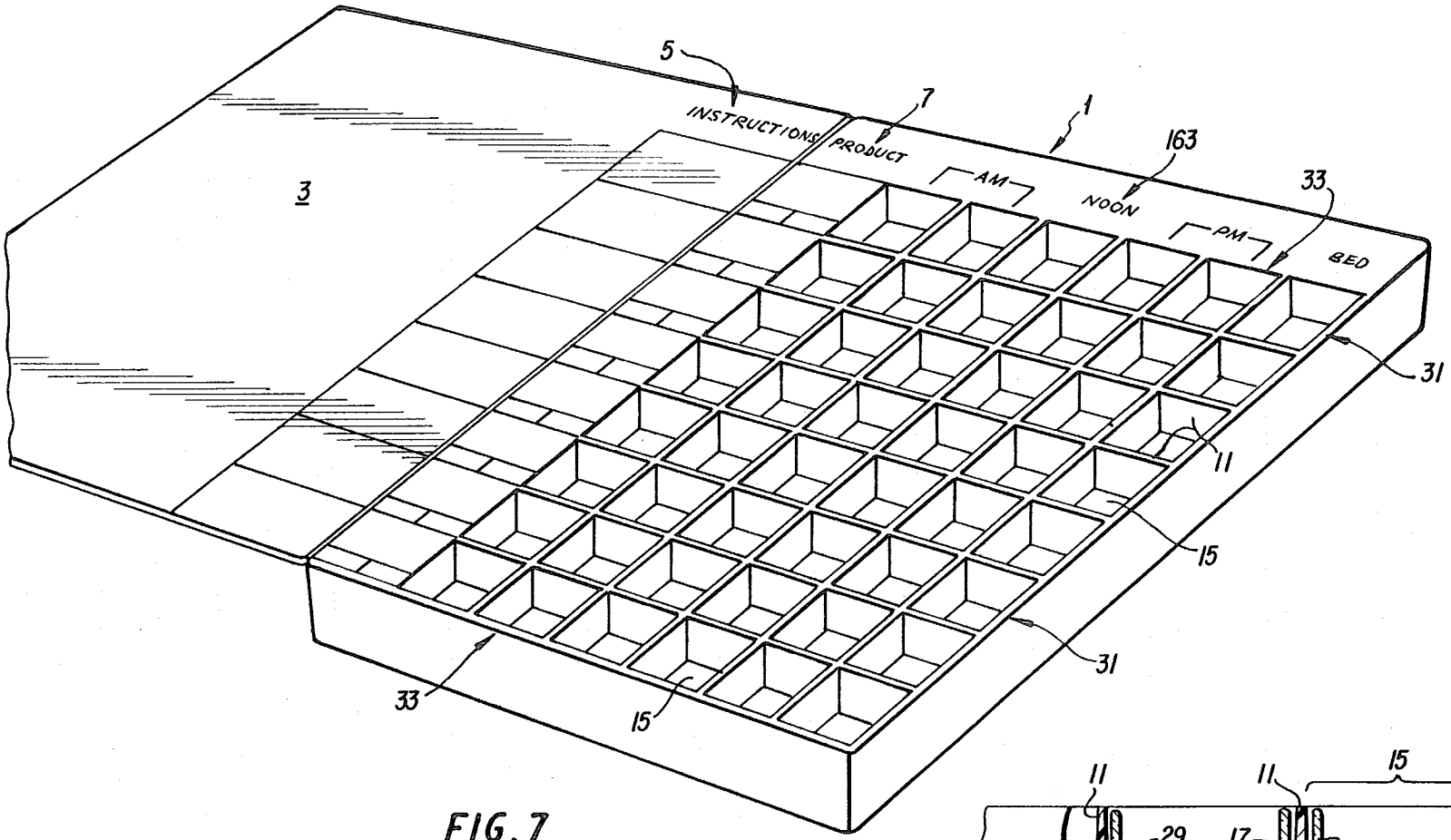
FIG. 7 is a perspective view of another embodiment of the medication container of the invention in open form.

FIG. 7 illustrates a perspective view of another embodiment of the invention. More specifically, the medication container/dispenser also includes a main body or tray 1 having a plurality of compartments 15 arranged in rows 31 and columns 33 therein.

Figure 8:
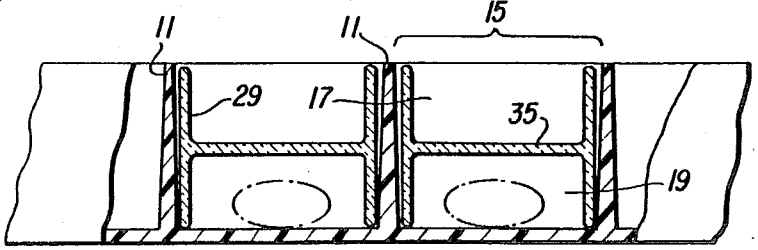
FIG. 8 is a partial cross-section side view of the embodiment of FIG. 7 showing the cavities thereof.

In the embodiment of FIGS. 7 and 8, each compartment 15 is also separated from the others by dividers 11. Furthermore, the compartments 15 will each include a removable insert 29 which divides the compartment 15 into two cavity like portions 17 and 19. Cavity 17 is open to the user and is used for containing a daily dose of medication therein for administration at a particular time of day, and cavity 19 is closed off to the user in a semipermanent mode, and in use contains a viewable single sample pill and/or sample dose of pills therein to ensure that the correct medication is placed in the open cavity 17. The walls enclosing cavity 19 are transparent for allowing viewing therethrough so that the contents of cavity 19 can be ascertained. Thus, in this case medication will again also be filled into the open portion for each compartment from conventional medication bottles or containers, and it is ensured that the correct medication is placed in the correct open cavity 17 by viewing each sample corresponding thereto through a transparent wall 35 making up the bottom of each cavity 17. This embodiment will not include a cassette 125.

Figure 9:
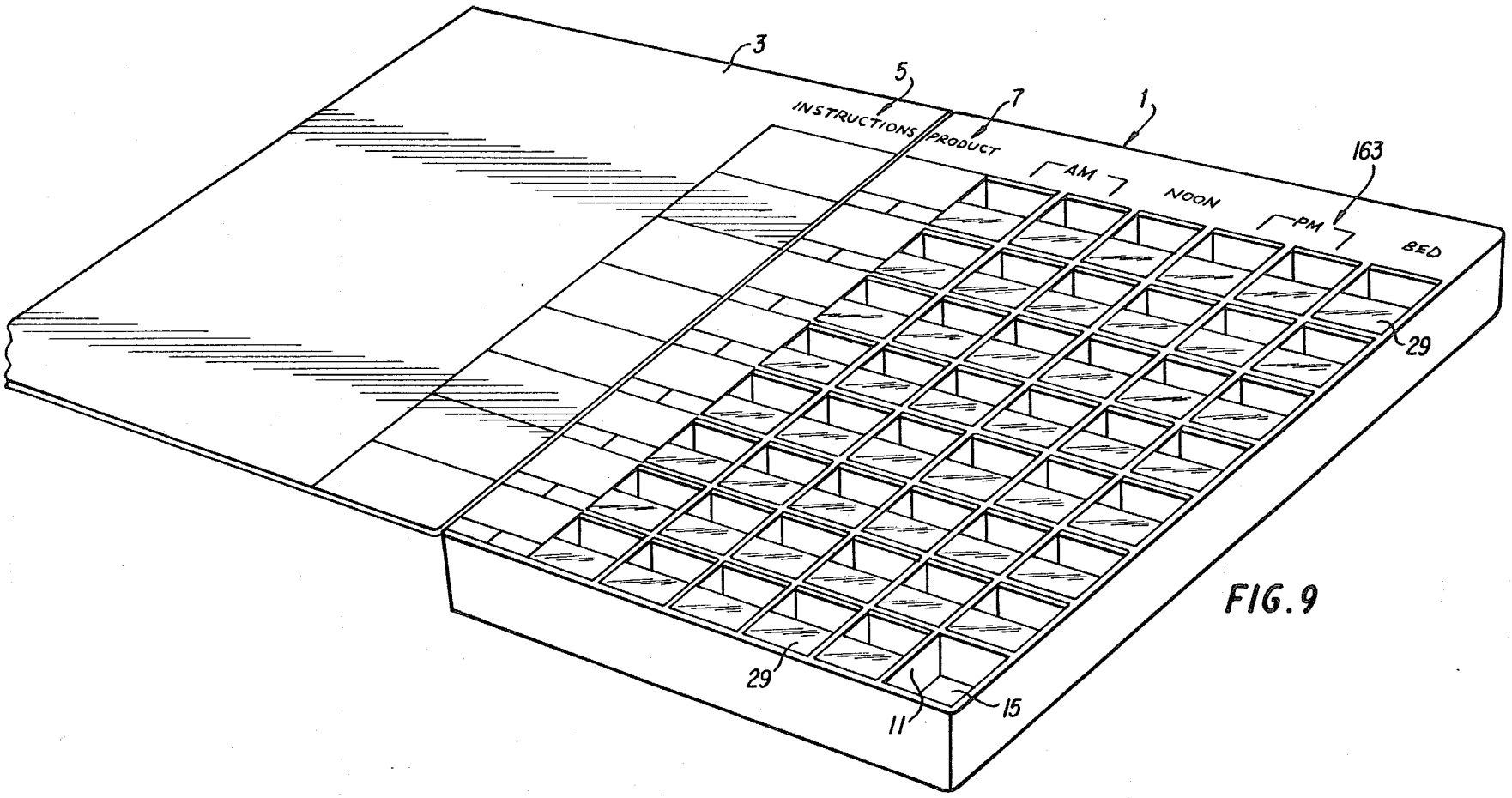
FIG. 9 is a perspective view of still another embodiment of the medication container of the invention in open form with not all the dual-structure cavities shown.
Figure 10:
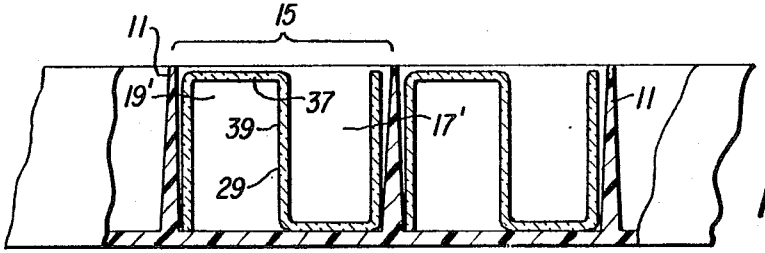
FIG. 10 is a partial cross-section side view of the embodiment of FIG. 9 showing the dual-structure cavities thereof.

In still another embodiment as shown in FIGS. 9 and 10, each compartment 15 will include a somewhat "S" shaped insert 29 wherein a closed portion or cavity 19' will be located adjacent an open portion or cavity 17'. A dividing wall 39 separates the two cavities 17' and 19', and the cavity 19' is closed off at the top from the user by a transparent wall 37. Thus, viewing of a sample of medication contained in cavity 19' is permitted.

Figure 2:
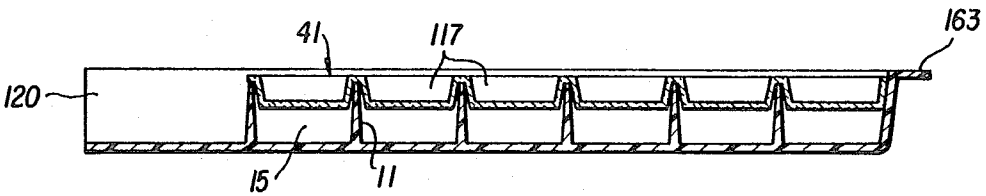
FIG. 2 is a cross-section view along line AA of the preferred embodiment of the medication container/dispenser of the invention with the outer lid open and the inner lid closed.
Figure 4:
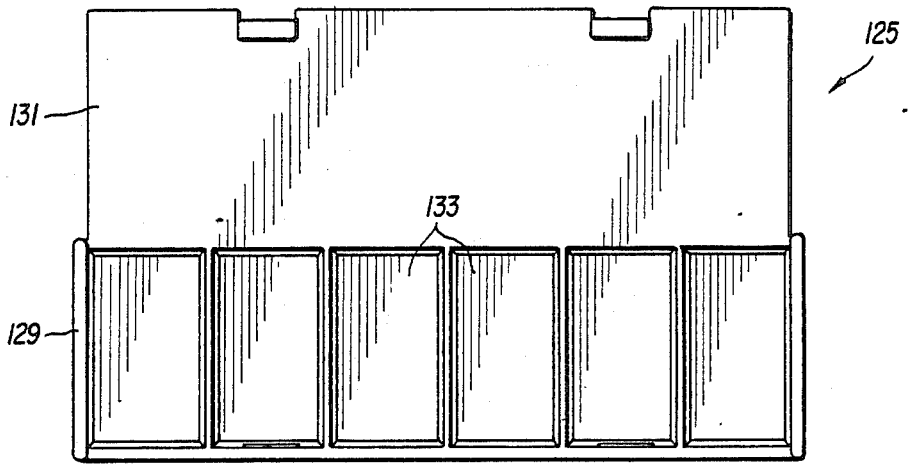
FIG. 4 is a top plan view of the cassette in open form.

Still another embodiment will include the compartment inserts shown in FIGS. 2 and 4 as being made integral, i.e., not as separate inserts, with the compartment section of the tray (not shown), i.e., with the dividers 11 arranged much in the manner of the depressed portions of the inner cover 41 of the preferred embodiment wherein an array of dual structure compartment is arranged as a single piece or unit. Therefore, to place the sample medication in the respective closed cavities, the entire array of compartments or cavity sections is lifted out of the main tray 1 and the respective sample medications are placed in the corresponding normally closed cavity areas in the tray. Thereby, when the compartment array section, similar to inner lid 41 of the preferred embodiment, is returned to its location in the tray, the sample medication for each compartment will be retained therein.

Referring again to FIG. 7, and to FIG. 9, the main tray 1 is shown with the rows 31 and columns 33 of compartments arranged therein. Appropriate indicia 163 are arranged on top of each column 33 for different times of the day. For example, as in the preferred embodiment the trays of FIGS. 7 and 9 show six columns, each one labelled on top with the appropriate time of the day at which the medication in each row 31 is to be taken. Additionally, in this case the figures show eight rows 31 with corresponding indicia labelling the product contained in each row. The cavities 15 are generally maintained closed by an inner cover (not shown in FIGS. 7 and 9) which will be transparent and not include the depressions of FIG. 1 inner cover 41 of the preferred embodiment. The inner cover is made transparent to allow easy viewing of all the caviites 15 to enable the user to ascertain whether the device has been filled with the medication for the day. Additionally, the inner cover can also be of either rigid or flexible construction.

Figure 3:
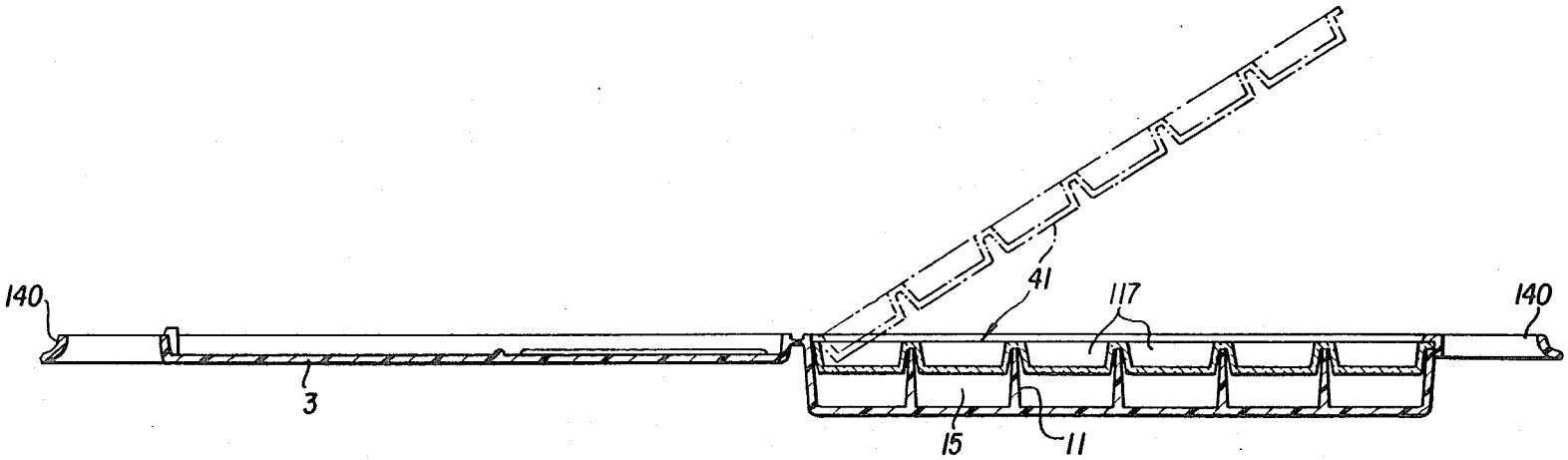
FIG. 3 is a side view in cross-section as in FIG. 2 along line BB.
Figure 5:
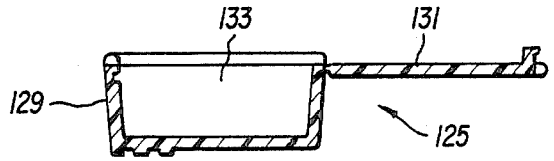
FIG. 5 is a side view in cross-section of the cassette in open form.
Figure 6:
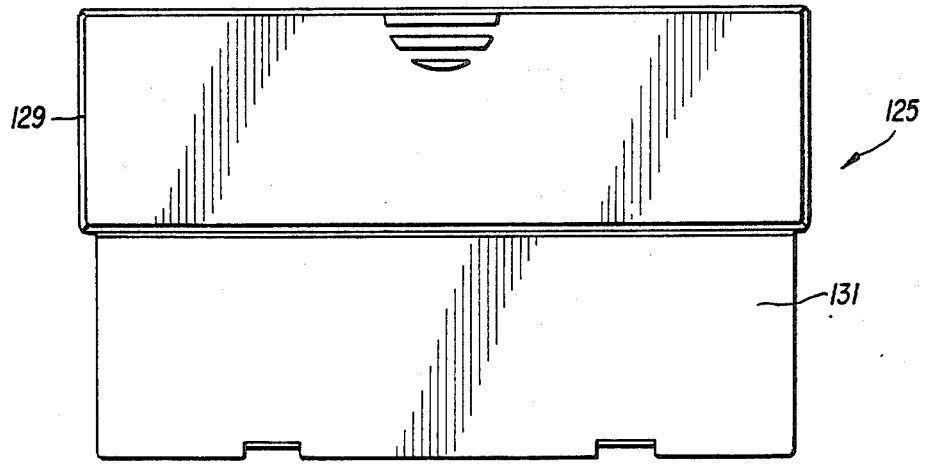
FIG. 6 is a bottom view, of the cassette in open form.

The inner cover will preferably, but not necessarily include latching means for maintaining it closed. Such latching means can include for example, a hock and corresponding engaging knob or other conventional means such as, but not limited to locks, VELCRO strips, and the like in the manner generally shown in FIGS. 3 and 5.

The inner cover is attached to the tray by a hinging arrangement also conventional in nature. The hinging arrangement can respectively comprise conventional hinges or a cutout portion or thinner portion at the connection of the inner cover to the tray when the cover is made integral with the tray, depending on the materials used in construction. With reference to the inner cover, it should be noted that it is positioned for only closing off access to the open sections 17 and 17'.

The tray 1 in all embodiments will also include the outer cover 3 for enclosing all the contents of the tray 1 therein. The cover 3 will, like in FIG. 1, include a column of indicia on the inside surface thereof with corresponding marking spaces 150 defined adjacent each row 31 of the tray 1. Accordingly, appropriate instructions for the administration of the medication and/or type of medication and the filling of the cavities 15 can be added. The hinging and latching arrangements described above for the inner cover 41 are also preferably the same for the outer cover 3. The connection between the outer cover and the tray can also be as previously described.

The various elements of the device can be made of materials such as plastic, cardboard, etc. depending on the durability desired. Likewise substances such as metal and wood can be used bearing in mind that certain specific elements of the invention are to be made transparent.

Nonetheless, plastic is the preferred material for the preferred embodiment, and the elements can be made by any technique such as vacuum forming or molding as will be apparent to those skilled in the art.

From the foregoing description, one skilled in the art can easily ascertain the essential characteristics of this invention, and without departing from the spirit and scope thereof, can make various changes and modifications of the invention to adapt it to various usages and conditions. For instance, the holding and display means and the tray can be integrally attached and articulable with respect to each other whereby the holding and display means can be folded over the tray for the purpose of achieving compactness. Alternatively, the holding and display means and tray can comprise a single unitary structure.

What is claimed is:

1. An apparatus for dispensing medical preparations comprising:

a tray having a plurality of dispensing means arranged in rows and columns with said dispensing means adapted for having placed thereinto medical preparations in predetermined amounts, and for containing and dispensing medical preparations respectively therefrom; and display means respectively associated with each of said dispensing means for enclosing and displaying a sample of the medication to be placed in and dispensed from each of said dispensing means, whereby the possibility of locating the wrong medication in a respective dispensing means is substantially reduced by comparision, with the sample medication located in the associated display means.

2. An apparatus for dispensing medical preparations as in claim 1, wherein said tray comprises:

a plurality of open compartments arranged in rows and columns for containing sample doses of medical preparations respectively therein; indicia means adjacent each row and column for labelling each column with a respective time of day that actual doses corresponding to the sample dose of medical preparations contained in the compartments are to be taken, and for labelling each row with a name of the sample doses of the respective medical preparations contained in the compartments thereof; and said dispensing means comprising a transparent lid for the compartment containing portion of said tray, and having a plurality of depressions defining cavities therein corresponding to each of said open compartments so as to extend into said compartments when said transparent lid is closed, said lid being adapted for secure closing over said compartments, and adapted for having the sample doses of medication preparations contained in each compartment viewable therethrough; said transparent lid being openable only by predetermined persons, and said depressed portions arranged, and of such a size, so as to permit filling with actual doses corresponding to the sample doses located respectively underneath, and in accordance with the instructions and time indication on said indicia adjacent each row and column, whereby by directly comparing the medication in each lid depressed portion with medication contained in the respective compartment by viewing through the bottom of the transparent lid depressed portion the probability of the wrong medication being placed in each depressed portions is reduced.

3. An apparatus for dispensing medical preparations as in claim 1, wherein said tray comprises:

a plurality of compartments arranged in rows and columns for containing medical preparations respectively therein; indicia adjacent each row and column respectively for labelling each column with a respective time of day that the medical preparations contained in the compartments thereof are to be taken, and for labelling each row with a respective name of the respective medical preparations and instructions for taking the medical preparations contained in the compartments thereof; and each compartment comprising a dual structure having a first open cavity and a second closed cavity, and said dispensing means comprising said first open cavity open to the user of the apparatus, and said sample display means comprising said second closed cavity, closed off from the user by a transparent enclosure in a semi-permanent manner, wherein said closed off second cavity is used to contain samples of the medication to be contained in said first open cavity whereby viewing the sample in said second portion, the first open cavities can be filled with the day's dose and probability of the wrong medical preparation being placed in said first open cavity of the corresponding compartment is substantially eliminated.

4. An apparatus as in claim 3, wherein said tray further comprises a single inner cover for closing off access to said cavities.

5. An apparatus as in claim 4, wherein said single inner cover is transparent.

6. An apparatus as in claim 3, wherein said tray further comprises an outer cover for closing off access to said cavities and for making said tray a compact easy to carry structure when closed.

7. An apparatus as in claim 2, further comprising latching means on said inner cover.

8. An apparatus as in claim 2, wherein said tray further comprises an outer cover for closing off access to the cavities of said inner cover.

9. An apparatus as in claim 8, further comprising latching means on said outer cover.

10. An apparatus as in claim 3, wherein said dual structure compartment is comprised of an S-shaped insert wherein said first open cavity is located adjacent said second open cavity.

11. An apparatus as in claim 3, wherein said dual structure compartment is comprised of an insert shaped like two letters U arranged back to back whereby said second closed cavity is located below said first open cavity.

12. An apparatus as in claim 3, wherein the array of dual structure compartments comprise a single integral unit removable from said tray.

13. An apparatus as in claim 1, wherein said tray and said sample display means are an integral unit.

14. An apparatus as in claim 1, wherein said tray and said sample display means are an integral unit and articulable with respect to each other.

15. An apparatus as in claim 1, wherein said tray and said sample display means comprise a unitary structure.

16. An apparatus for dispensing medical preparations as in claim 2 further comprising cassette holding means, and a cassette adapted for being removably held therein.

17. An apparatus for dispensing medical preparations as in claim 16, wherein said cassette comprises a main body having six cavities arranged in a row for containing medication therein and a cover having indicia arranged on one of the inner surface or outer surface thereof, in a position adjacent each cavity for identifying the time at which medication in each cavity is to be taken whereby medication which is arranged in each column of inner lid depressed portions can be pooled into a respective cavity of the cassette, which is then removed from the tray for ease in carrying the medication.

18. An apparatus for dispensing medical preparations comprising:

a tray having a plurality of dispensing means arranged in rows and columns with medical preparations placed therein in predetermined amounts, and adapted for dispensing the medical preparations respectively therefrom; and display means respectively associated with each of said dispensing means enclosing and displaying a sample of the medication placed in and to be dispensed from each of said dispensing means, whereby the possibility of the wrong medication being located in a respective dispensing means is substantially reduced by comparing medication to be dispensed from the dispensing means with the sample medication located in the associated display means.

19. An apparatus for dispensing medical preparations as in claim 18, wherein said tray comprises:

a plurality of open compartments arranged in rows and columns and containing sample doses of medical preparations respectively therein; indicia means adjacent each row and column labelling each column with a respective time of day that actual doses corresponding to the sample dose of medical preparations contained in the compartments thereof; and said dispensing means comprising a transparent lid covering the compartment containing portion of said tray, and having a plurality of depressions defining cavities therein corresponding to each of said open compartments and extending into said compartments when said transparent lid is closed, said lid being adapted for secure closing over said compartments, and the sample doses of medical preparations contained in each compartment viewable therethrough; said transparent lid being openable only by predetermined persons, and said depressed portions arranged, and of such a size, so as to be filled with actual doses corresponding to the sample doses located respectively underneath, and in accordance with the instructions and time indication on said indicia adjacent each row and column, whereby by directly comparing medication in each lid depressed portion with medication contained in the respective compartment by viewing through the bottom of the transparent lid depressed portion the probability of the wrong medication being placed in each dispensing means depressed portions is reduced.

20. A method of dispensing medications, which comprises dispensing medications at spaced intervals from a tray having a plurality of dispensing means arranged in rows and columns, with the medications being dispensed in predetermined amounts respectively from the dispensing means in accordance with indicia adjacent each row and column identifying the medications and the time of day the medications are to be taken, and wherein, prior to dispensing, the medications in each dispensing means are visually compared with an associated sample display means containing a sample of the medication to be dispensed from its associated dispensing means to minimize the possibility of the wrong medication being dispensed from any one of the dispensing means.

21. A method as in claim 20 further comprising the step of adding a sample medication to each sample display means to permit said visual comparison.

22. A method as in claim 21 further comprising viewing the sample medication in each sample display means and adding the same medication to the associated dispensing means in an amount of the medication to be dispensed at the appropriate interval.

23. A method as in claim 22 comprising the step of storing medications in the tray between dispensing step intervals.

* * * * *